United States Patent [19]

Watson

[11] 4,174,595

[45] Nov. 20, 1979

[54] ANCHOR EYE PROTECTOR

[76] Inventor: Gary Q. Watson, Box F, Del Rio, Tex. 78840

[21] Appl. No.: 880,785

[22] Filed: Feb. 24, 1978

[51] Int. Cl.[2] ..... E02D 5/74

[52] U.S. Cl. ..... 52/166; 52/146

[58] Field of Search ..... 52/166, 146, 147, 155, 52/156, 157, 158, 159, 160, 170

[56] References Cited

U.S. PATENT DOCUMENTS

| | | | |
|---|---|---|---|
| 2,243,886 | 6/1941 | Scott | 52/160 |
| 3,675,381 | 7/1972 | Watson | 52/166 |

*Primary Examiner*—Carl D. Friedman

*Attorney, Agent, or Firm*—Wendell Coffee

[57] ABSTRACT

Anchor rods are protected against corrosion by inserting sealant within an anchor eye cap recess and bottom nut recess before fastening the eye and anchor member to the rod. Protective rod covering also is within the recesses.

6 Claims, 2 Drawing Figures

ANCHOR EYE PROTECTOR

BACKGROUND OF THE INVENTION (1) Field of the Invention

This invention relates to earth anchors and more particularly to anchor rods to which an anchor eye cap and an anchor member are affixed.

(2) Description of the Prior Art

It has been recognized that the corrosion of metal objects in the earth is largely an electrolysis process; therefore people have attempted to prevent the electrolysis by charging the metal object with electrical generators. Generally, this process is called "cathodic" protection. However, usually for short, small objects buried in the ground, such as anchors for guy wires, the only effort to protect them is to put a coating on them such as galvanization or paint. My prior U.S. Pat. No. 3,675,381 discloses electrically insulating the rod from the anchor and the surrounding soil.

However, even with the use of paint, galvanization, asphalt mastic or plastic tubing around the anchor rod to protect it from corrosion, as the anchor eye cap and bottom nut are secured to the anchor rod, the outer limits or ends of the rod coating are left unsealed. This results in corrosion to the anchor rod at this point.

SUMMARY OF THE INVENTION (1) New and Different Function

I have solved the problem of preventing corrosion to anchor rods that occurs when anchor eye caps and bottom nuts are affixed to the anchor rod. I have accomplished this by recessing the anchor eye and bottom nut and filling this recess with water proofing material to seal the ends of the rod coating to the anchor eye and botton nut.

Thus, it may be seen that the total function is far greater than the sum of the individual functions of the rods, rod covers, recesses, etc.

(2) Objects of this Invention

An object of this invention is to provide permanent anchors.

Another object is to reduce corrosion on anchor rods.

Further objects are to achieve the above with a device that is sturdy, compact, durable, lightweight, simple, safe, efficient, versatile, ecologically compatible, energy conserving, and reliable, yet inexpensive and easy to manufacture, and install.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
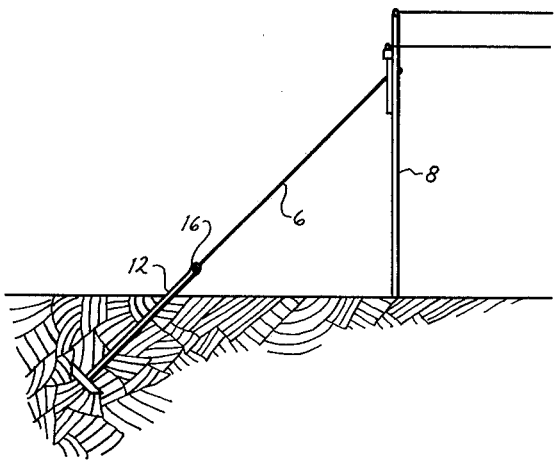
FIG. 1 is a representation of an anchor and rod according to my invention attached to a utility pole.
Figure 2:
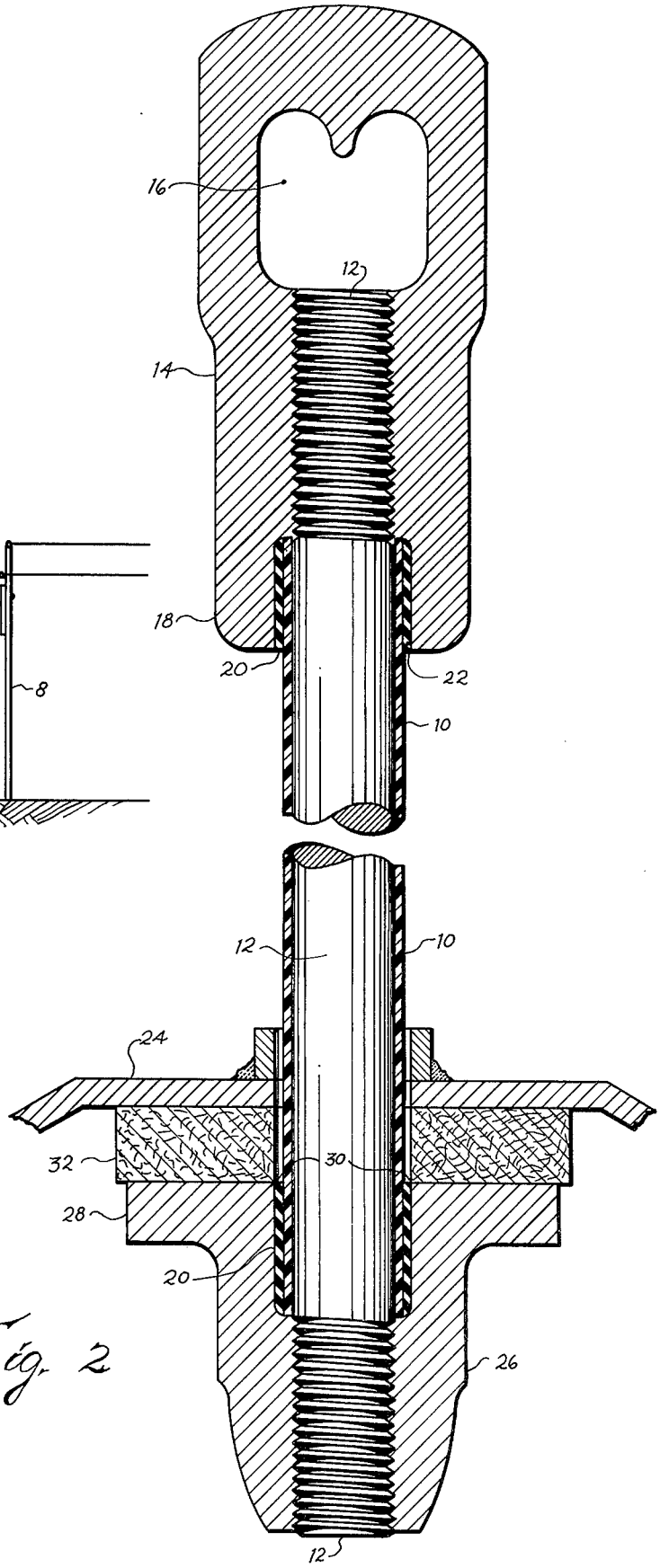
FIG. 2 is an axial sectional view of an anchor, according to my invention.

Anchors are used for many purposes, one example of which is to attach guy wire 6 to pole 8. FIG. 1 shows such an installation where the guy is attached through anchor eye 16 on anchor rod 12 of an anchor.

Protective cover 10 surrounds the anchor rod 12. Eye cap 14 containing the eye 16 is secured over the top of the anchor rod 12. The eye 16 provides convenient, conventional means by which a tension member may be attached to the rod. Eye flange 18 on the bottom portion of the eye cap 14 telescopes over the rod 12 and also over the protective cover 10. The eye cap 14 is secured to the rod above eye flange 18. The cap is secured to rod 12 by external threads on top of the rod 12 and internal threads in the top of the eye cap 14.

Insulating material 20, such as asphalt, is placed in the recess which extends from open end 22 of the eye cap 14 and the threads. The material is in the cap before the rod 12 is secured to the cap 14. This results in insulating material 20 sealing the protective covering 10 from eye cap 14. Therefore, there is no corrosion problem at this point.

It will be understood that the protective cover 10 around the anchor rod may be a plastic sleeve or asphalt material covered by a plastic sleeve or the like. Therefore, it is highly desirable to have the flange on the eye cap extending over the top of the cover to contain the top or to protect the top from damage as well as to seal the top of the protective cover. It may be seen that with the insulating material 20, which is itself a sealant, there is a good seal formed at the top of the protective coating so that no moisture or other corrosive fluids can seep into a void between the protective covering and the rod. By filling the cap with a sealant material before it is applied to the rod, the sealant material will also form a lubricant as well as an insulation barrier between the threads of the cap 14 and the threads of the top of the rod 12.

Anchor member 24 is attached to the anchor rod 12 by bottom nut 26. The anchor 24 is an outward extending member which prevents axial movement of the anchor rod 12. Anchor members are well known to the art. Nut 26 is attached below the anchor member 24 and over the anchor rod 12. Nut flange 28 on the top portion of the bottom nut 26 telescopes over the rod 12 and protective covering 10. The flange 28 forms a recess between the nut and the rod cover forming the same structure and function as the recess within the eye cap. Nut 26 is secured to rod 12 by external threads on the bottom of the rod 12 and internal threads on the lower portion of the bottom nut 26, i.e., anchor member 24 has a hole through which the rod 12 extends. Washer 32 of electrical insulating material surrounds the rod 12 immediately below the anchor member 24. Nut 26 is secured to rod 12 below washer 32, securing rod 12 to anchor member 24.

Insulating material 20, such as asphalt, is placed in the recess extending between the open end 30 and the threads of the nut 26, as with the eye cap. This results in insulating material 20 sealing protective covering 10 from the bottom nut 26. Therefore, there is no corrosion problem at this point.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In an earth anchor having a. an anchor member embedded in the earth, b. a rod extending from the anchor member to above the earth, c. an eye on the end of the rod for attaching a tension member to the rod, and d. protective covering on the rod to impede corrosion of the rod;

the improved structure attaching the eye to the rod comprising:

e. an eye cap having said eye as a part thereof, f. an eye flange forming a recess on the bottom of the eye cap telescoped over the rod and also over said protective covering, g. said eye cap secured to the rod above said eye flange.

2. The invention as defined in claim 1 further comprising:

h. placing sealant material in the recess between the flange of said eye cap and said rod and protective covering.

3. The invention as defined in claim 2 wherein said sealant material is asphalt.

4. The invention as defined in claim 3 wherein said cap is secured to the rod by j. external threads on the top of the rod, and k. internal threads in the top of the eye cap.

5. The invention as defined in claim 4 further comprising:

m. a bottom nut below the anchor member, and n. a nut flange forming a recess on the top of the bottom nut telescoped over the rod and also over the protective coating, o. said bottom nut secured to the rod below said nut flange.

6. In an earth anchor having a. an anchor member embedded in the earth, b. a rod extending from the anchor member to above the earth, c. an eye on the end of the rod for attaching a tension member to the rod, and d. protective covering on the rod to impede corrosion of the rod;

the improved structure attaching the anchor member to the rod comprising:

e. a bottom nut below the anchor member, f. a nut flange forming a recess on the top of the bottom nut telescoped over the rod and also over the protective coating, g. said bottom nut secured to the rod below said nut flange, and h. an eye cap having said eye as a part thereof, j. an eye flange forming a recess on the bottom of the eye cap telescoped over the rod and also over said protective covering, k. said eye cap secured to the rod above said eye flange.

* * * * *